US010974377B2

(12) United States Patent
Donner

(10) Patent No.: US 10,974,377 B2
(45) Date of Patent: Apr. 13, 2021

(54) SETTING TOOL, SET FOR A SETTING TOOL SYSTEM, AND SETTING TOOL SYSTEM

(71) Applicant: Hilti Aktiengesellschaft, Schaan (LI)

(72) Inventor: Tobias Donner, Kaufering (DE)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 16/611,561

(22) PCT Filed: Jun. 25, 2018

(86) PCT No.: PCT/EP2018/066890
§ 371 (c)(1),
(2) Date: Nov. 7, 2019

(87) PCT Pub. No.: WO2019/007726
PCT Pub. Date: Jan. 10, 2019

(65) Prior Publication Data

US 2020/0391363 A1 Dec. 17, 2020

(30) Foreign Application Priority Data

Jul. 5, 2017 (EP) ..... 17179766

(51) Int. Cl.
*B25B 31/00* (2006.01)
*B25B 13/06* (2006.01)

(52) U.S. Cl.
CPC ..... *B25B 31/00* (2013.01); *B25B 13/06* (2013.01); *B25D 2216/0023* (2013.01)

(58) Field of Classification Search
CPC ... B25B 31/00; B25B 21/007; B25B 23/0035; B25D 17/005
See application file for complete search history.

(56) References Cited

U.S. PATENT DOCUMENTS 3,979,918 A 9/1976 Vidler
6,050,157 A * 4/2000 Ludwig ..... B25B 13/06 81/121.1

(Continued)

FOREIGN PATENT DOCUMENTS

FR 2 254 715 7/1975
JP 58-136268 9/1983

(Continued)

OTHER PUBLICATIONS

Written Opinion dated Oct. 15, 2018 in PCT/EP2018/066890 and English translation, 9 pages.

(Continued)

*Primary Examiner* — Tyrone V Hall, Jr.
(74) *Attorney, Agent, or Firm* — Grüneberg and Myers PLLC

(57) ABSTRACT

A setting tool is used for a setting tool system for setting capsule anchors, wherein the setting tool includes a shank and a head arranged at one end of the shank having a connecting section to which a drive head of a capsule anchor may be connected, wherein the shank includes in a threaded section which is adjacent to the head, a thread, and a thread-free section at an end of the shank opposite the head. Further, a set is used for a setting tool system for setting capsule anchors, including an adapter, which may be coupled to a drive machine, and at least one setting tool. Additionally, a setting tool system includes a setting tool or a set for a setting tool system and a capsule anchor and/or a drive machine.

19 Claims, 3 Drawing Sheets

(56) References Cited

U.S. PATENT DOCUMENTS

| | | | | |
|---|---|---|---|---|
| 8,893,372 | B2 * | 11/2014 | Fanourgiakis | B25D 17/005 29/525.11 |
| 2007/0131440 | A1 | 6/2007 | Hashimoto et al. | |
| 2013/0161038 | A1 * | 6/2013 | Prunean | B25B 23/00 173/1 |

FOREIGN PATENT DOCUMENTS

| | | |
|---|---|---|
| JP | 2007-160418 | 6/2007 |
| JP | 2010-167531 | 8/2010 |

OTHER PUBLICATIONS

International Search Report dated Oct. 15, 2018 in PCT/EP2018/066890 with English translation, 5 pages.
Written Opinion dated Oct. 15, 2018 in PCT/EP2018/066890, 5 pages.

* cited by examiner

SETTING TOOL, SET FOR A SETTING TOOL SYSTEM, AND SETTING TOOL SYSTEM

This application is a National Stage entry under § 371 of International Application No. PCT/EP2018/066890, filed on Jun. 25, 2018, and which claims the benefit of European Application No. 17179766.5, filed on Jul. 5, 2017.

BACKGROUND OF THE INVENTION

Field of the Invention

The present invention relates to a setting tool and to a set for a setting tool system and to a setting tool system for setting capsule anchors.

Discussion of the Background

Capsule anchors are chemical anchors that are used to fasten heavy loads, predominantly in substrata composed of concrete. In order to set a capsule anchor, a capsule is inserted into a cleaned borehole. Subsequently, an anchor rod of the capsule anchor is introduced into the borehole provided with the capsule, by rotating it, wherein the capsule breaks and releases at least two components that are mixed by means of the rotation of the anchor rod, and subsequently react chemically with one another. As a result, a force-fit and shape-fit connection of the capsule anchor with the substratum, in particular the surroundings of the borehole, takes place.

To set a capsule anchor, a setting tool and a drive machine, as well as a borehole, a capsule, and an anchor rod are required. The setting tool is configured for transferring a movement of the drive machine to the capsule anchor.

In series applications, high costs occur as the result of the setting tools, because different setting tools are required for anchor rods having different sizes. Furthermore, in the case of series applications, multiple setting tools having the same size frequently have to be acquired, since the setting tools can only be removed from the capsule anchor after the chemical components have cured.

SUMMARY OF THE INVENTION

It is therefore a task of the present invention to make available an optimized setting tool that can be variable connected with further parts of a setting tool system, a set, and a setting tool system, with which capsule anchors of different sizes can be installed. Furthermore, it is the task of the present invention to make available a flexible setting tool that is suitable for use with a percussion drill or with a cordless drill/screwdriver.

This task is accomplished, according to the invention, by means of a setting tool for a setting tool system for setting capsule anchors, wherein the setting tool has a shaft and a head arranged at one end of the shaft, having a connection section with which a drive head of a capsule anchor can be connected, wherein the shaft has a thread in a threaded section that borders on the head, and a thread-free section on an end of the shaft that lies opposite the head.

Such a setting tool has the advantage that it can not only be screwed into a correspondingly configured adapter by means of the threaded section, but can also be connected with a drive machine directly by means of the thread-free section. As a result, the setting tool can be used in flexible manner. For example, it can be coupled with a drive machine configured as a (cordless) drill/screwdriver. Accordingly, the user is flexible in the selection of the drive machine.

DETAILED DESCRIPTION OF THE INVENTION

Figure 1:
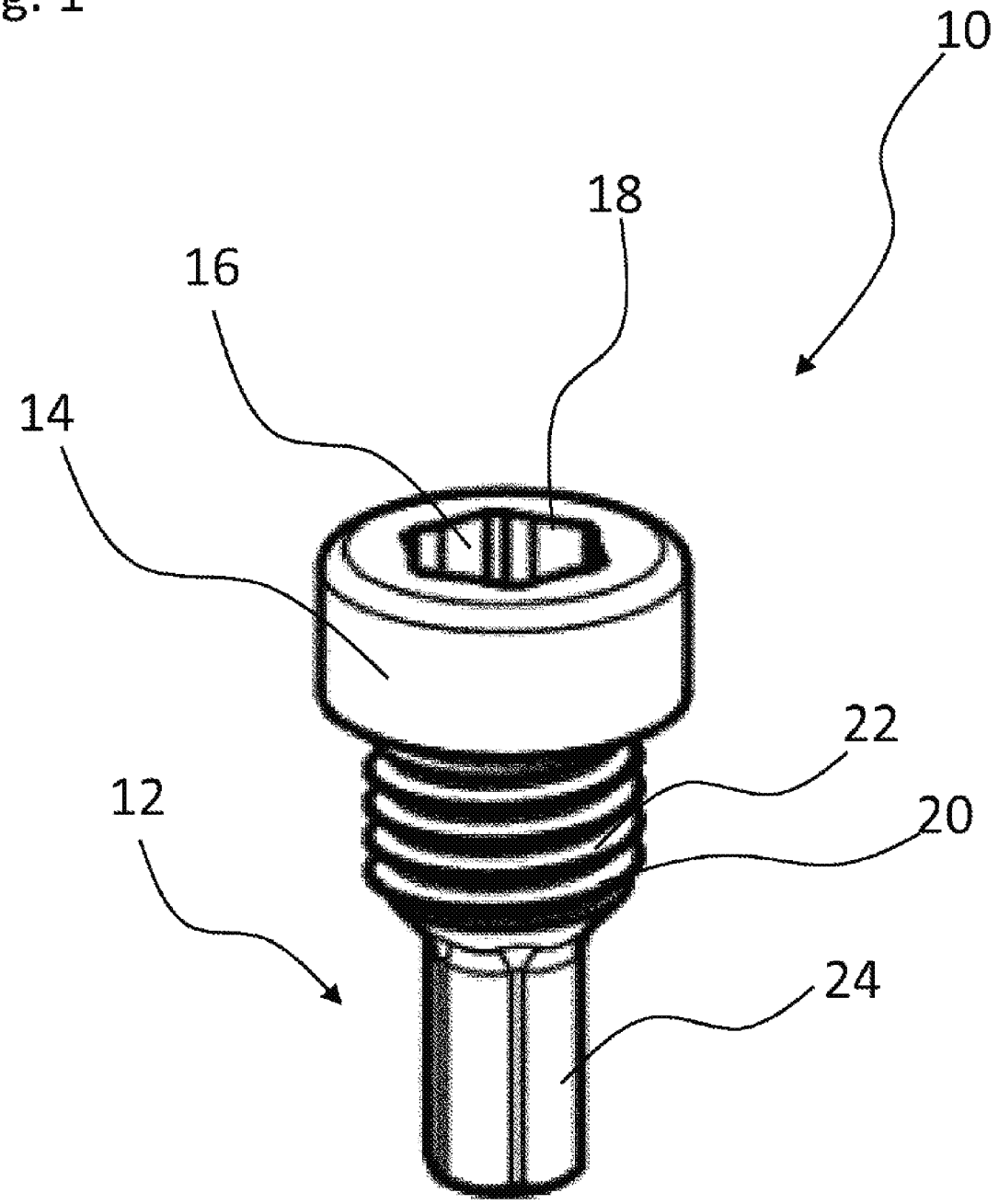
FIG. 1 shows a setting tool according to the invention.

According to one embodiment, the connection section is configured as a recess in the head of the setting tool. As a result, a capsule anchor can be connected with the setting tool by means of a rapid hand movement, in that the anchor is inserted into the recess, so that a force can be transferred from the drive machine to the capsule anchor, by way of the setting tool. It is just as easy to separate the capsule anchor from the setting tool once the anchor has been countersunk into the borehole, so that a further capsule anchor can be set directly.

The recess preferably has a hexagonal shape, in particular a hexagonal socket geometry. This geometry can interact with a corresponding external hex geometry of a capsule anchor, in particular an anchor rod of the capsule anchor.

According to an alternative embodiment, the connection section is configured as a pin. The pin can have a hexagonal profile; in particular, it can be an axially projecting hexagonal shaft. As a result, the setting tool can interact with a corresponding hexagonal socket geometry of the capsule anchor; in particular, it can engage into the rod with shape fit.

Reliable transfer of force from the setting tool to the capsule anchor can take place by means of the correspondingly configured connection section of the setting tool. In this way, it is guaranteed that the capsule anchor is properly installed in the substratum.

The thread-free section of the setting tool preferably has a hexagonal profile. As a result, the setting tool can be inserted into a jaw chuck holder of a drill/screwdriver, in particular into a three-jaw chuck holder that is generally used. The setting tool can thereby advantageously be coupled with a drive machine directly, without using an adapter.

The setting tool is preferably configured in one piece. As a result, the setting tool can be used in particularly simple manner when setting a capsule anchor, wherein the forces can be transferred accordingly. Furthermore, production of the setting tool is simplified on the basis of the one-piece configuration.

Furthermore, the task is accomplished, according to the invention, by means of a set for a setting tool system for setting capsule anchors, having an adapter, which can be coupled with a drive machine, and at least one setting tool.

Such a set has the advantage that the geometry of the setting tool does not have to correspond to the geometry of a corresponding holder of the drive machine, but rather that the setting tool can be coupled with the drive machine by means of the adapter. For this purpose, the setting tool and the adapter can be connected with one another, for example by means of a force-fit or shape-fit connection.

According to a preferred embodiment, the set has multiple setting tools, for example at least two, in particular at least four setting tools. In this way, the set can have multiple setting tools for a connection with capsule anchors having different configurations, in particular with regard to the size of the anchor rod of the capsule anchors or with regard to the drive head.

The connection sections of the multiple setting tools can be configured to be different in size. In this way, the setting tools can be coupled with capsule anchors having different sizes. According to a preferred embodiment, the set can have multiple setting tools, which can be connected, in each instance, with a capsule anchor having the size M8, M10, M12, and M16. In this regard, the setting tools have connection sections that correspond to this.

The threaded sections and/or the thread-free sections of the multiple setting tools are preferably configured to be the same. In this manner, all the setting tools of a set can be connected with the same adapter or the same drive machine. As a result, the number of tools in the set can be kept small, and thereby the production costs are also slight. For example, all the setting tools of the set can be connected with the adapter of the set, in particular by way of the corresponding threaded section of the respective setting tool.

For example, the adapter has an SDS insertion end, in particular an SDS-Plus or SDS-Max insertion end. By means of the SDS insertion end, the adapter can be connected with a correspondingly configured drive machine that has an SDS holder. The term "SDS" refers to a drill shaft system for percussive and rotating machine tools such as drills and hammer drills, in particular cordless drills. In the case of this insertion system, the shaft is provided with special grooves that guarantee better transfer of force and, at the same time, percussion. In contrast to other insertion systems, the SDS shaft allows tool-free and rapid changing of drill bits and chisels. Instead of the term SDS-Plus or SDS-Max, the abbreviation TE-C or TE-Y is also frequently used.

According to a preferred embodiment, the adapter has a holding section at an end opposite the insertion end for holding the setting tool. The setting tool can thereby be coupled with the drive machine by way of the adapter.

The holding section has a thread, for example, in particular an inside thread. The inside thread can correspond to the thread of the setting tools in the threaded section, so that the setting tools can be screwed together with the adapter, so that it is connected with shape fit or force fit. The setting tool can thereby be connected with the adapter in reliable but nevertheless releasable manner. The setting tools can easily be changed, in that they are screwed onto or unscrewed from the adapter. In this regard, all the setting tools of the set have a threaded section that corresponds to the thread of the holding section. Setting tool and adapter are configured in such a manner that in interplay, a guide for screwing the thread in occurs. As a result, it is prevented that the thread is tilted.

Furthermore, a setting tool system is indicated, comprising a setting tool that is configured as described above, or a set having a corresponding setting tool and an adapter, which is configured as described above, as well as a capsule anchor and/or a drive machine. By means of the setting tool system, all the components required for setting one or more capsule anchors are made available to a user. The drive machine can be a hammer drill, a cordless drill or, in general, a drill/screwdriver.

Figure 2:
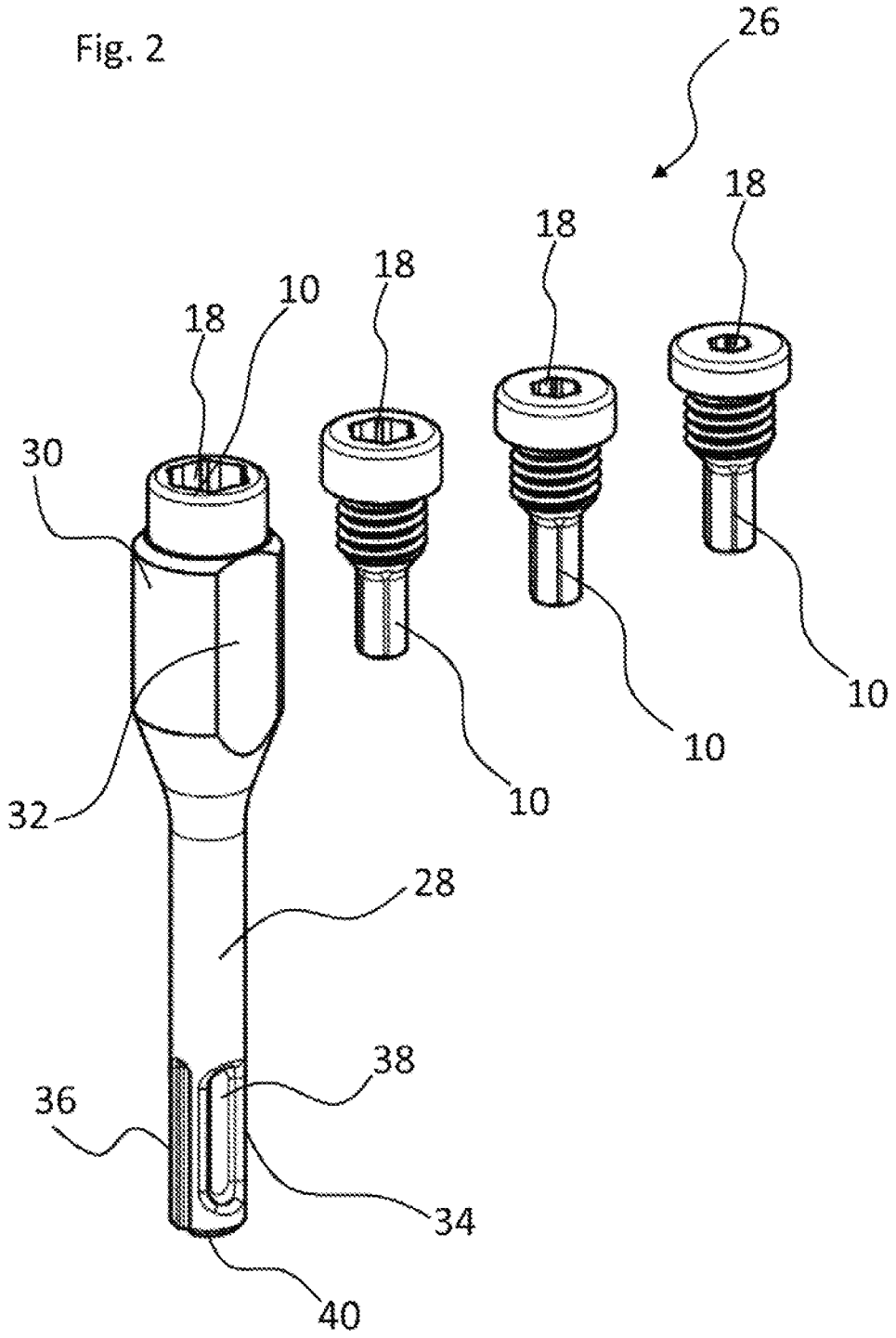
FIG. 2 shows a set according to the invention having multiple setting tools.

Further characteristics and advantages of the invention are evident from the following description and from the following drawings, to which reference is made. In the drawings, the figures show:

FIG. 1 a setting tool according to the invention,

FIG. 2 a set according to the invention having multiple setting tools, and

Figure 3:
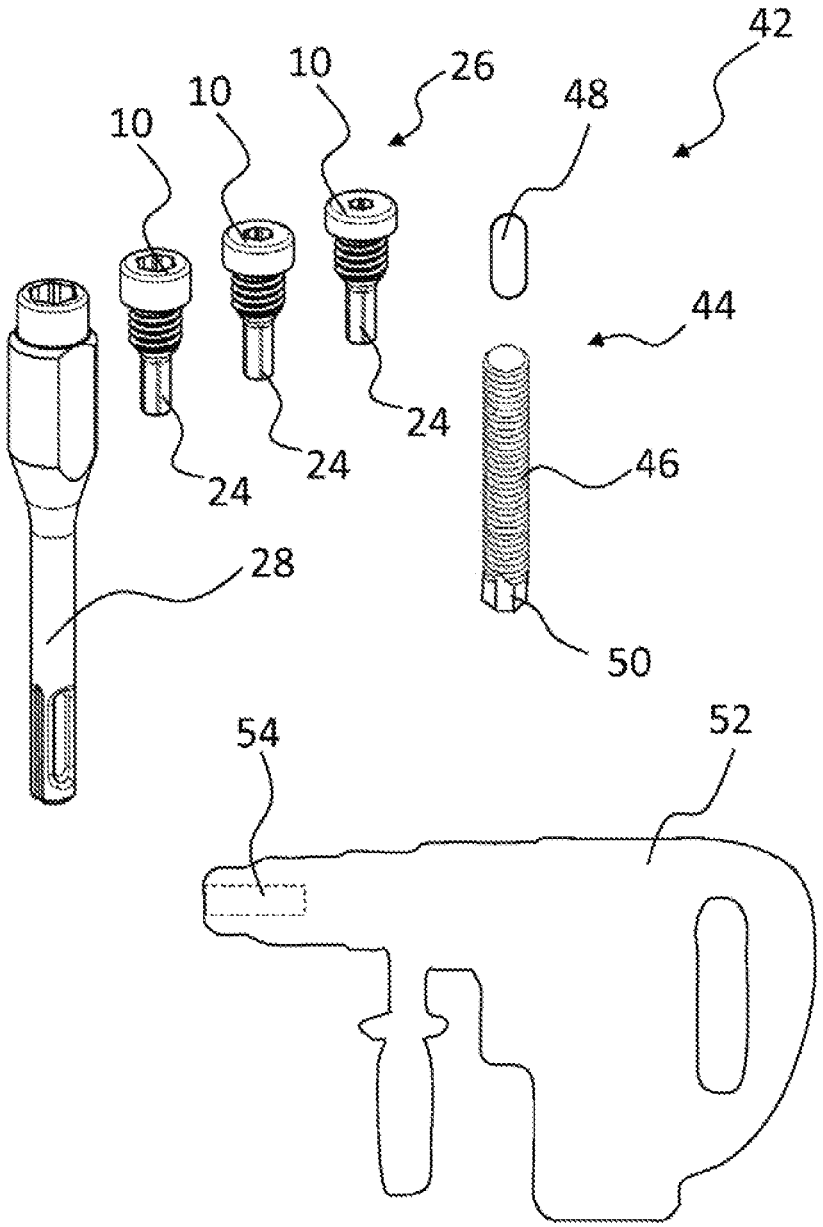
FIG. 3 shows a setting tool system according to the invention.

FIG. 3 a setting tool system according to the invention.

FIG. 1 shows a setting tool 10 for setting capsule anchors. The setting tool 10 has a shaft 12 and a head 14 arranged at one end of the shaft 12.

A connection section 16 is arranged on the head 14, wherein the connection section 16 comprises a recess 18. The connection section 16 is particularly formed by the recess 18. The recess 18 is a depression having a hexagonal profile; in particular, the recess 18 has a hexagonal socket geometry.

In general, the connection section 16 or the recess 18 is arranged in the end face of the head 14, which faces away from the shaft 12.

An end of the capsule anchor can be inserted into the recess 18, in particular with shape fit, which end is also referred to as a drive head. As a result, a drive torque can be transferred from the setting tool 10 to the capsule anchor. For this purpose, the capsule anchor has a corresponding external hex geometry on an anchor rod, which is coupled with a capsule, as will still be explained below.

The shaft 12 has a threaded section 20 having a thread 22 and a thread-free section 24. In this regard, the thread-free section 24 can serve to directly connect the setting tool 10 with a drive machine, not shown here. For this purpose, the thread-free section 24 has a hexagonal profile, in particular a hexagon profile, by means of which the setting tool 10 can be coupled with a three-jaw chuck of the drive machine, for example. Alternatively, the thread-free section 24 can also have a quadrangular profile, in particular a square profile.

By means of the threaded section 20, the setting tool 10 can be connected with an adapter shown in FIG. 2, in particular screwed into it. The adapter is used, above all, if the geometry of the thread-free section 24 does not agree with the geometry of the holder of the drive machine. Furthermore, further functions can be made available by way of the adapter, as will still be explained below.

The setting 10 accordingly has essentially three regions, namely the connection section 16 at a first end, the threaded section 20 that follows it, as well as the thread-free section 24 at the other end, by way of which the setting tool 10 can be directly connected with a drive machine. These three sections 16, 20, 24 make a transition into one another.

FIG. 2 shows a set 26 for setting capsule anchors, consisting of an adapter 28 and four different setting tools 10. The recesses 18 of the respective setting tools 10 are configured in different sizes. As a result, each setting tool 10 can be coupled with a specific capsule anchor, which has a size that corresponds to the corresponding recess 18 of the setting tools 10. For example, the setting tools 10 that are shown in FIG. 2 can be coupled with capsule anchors having the thread sizes M8, M10, M12, and M16.

The shaft 12, in particular the threaded section 20 and the thread-free section 24, can be configured identically in the case of each of the setting tools 10. As a result, all the setting tools 10 can be connected with the one adapter 28.

In order to connect a setting tool 10 with the adapter 28, the setting tool 10 can be screwed onto the adapter 28 by means of the threaded section 20. For this purpose, the adapter 28 has a thread that corresponds to the threaded section 20 on its holding section 30. This thread is configured as an inside thread, which corresponds to the outside thread of the threaded section 20 of the respective setting tool 10. The thread of the adapter 28 cannot be seen in FIG. 2, since a setting tool 10 is already shown in connection with the adapter 28.

In this regard, a shape-fit or force-fit threaded connection is produced between the setting tool 10 that is being used and the adapter 28.

Since the setting tools 10 are coupled with the adapter 28 by way of the corresponding threaded section 20, in each instance, it is sufficient if the threaded sections 20 of the different setting tools 10 are configured to be the same, in each instance. With regard to the thread-free sections 24 of the setting tools 10, it merely has to be ensured that these can be held in the adapter 28.

At one end of the adapter 28, on which the thread of the adapter 28 is also arranged, the adapter 28 has at least one key surface 32, which is configured as an outside flattened part on the adapter 28. This key surface 32 serves for being able to release the setting tool 10 in simple manner, for example using a corresponding tool.

The adapter 28 furthermore has an insertion end 34, which is provided on the end that lies opposite the holding section 30. The adapter 28 can be coupled with a drive machine using the insertion end 34. Here, the insertion end 34 is configured as an SDS-Plus insertion end. Optionally, this can also be structured as an SDS-Max insertion end, in particular in order to be able to hold setting tools with which anchor rods having a size of M20 or greater can be set. In this regard, SDS describes an insertion system in which the insertion end 34 is provided with special grooves, which guarantee better transfer of force and, at the same time, percussion. In particular, the insertion end 34 has two longitudinal grooves 36, which extend in the longitudinal direction of the adapter 28 all the way to the end of the adapter 28, at which the insertion end 34 is formed. In FIG. 2, only one of the longitudinal grooves 36 can be seen, since the second longitudinal groove 36 is situated on the opposite side of the adapter 28. The adapter 28 can be inserted into a drive machine with shape fit by means of the longitudinal grooves 36, in accordance with the key/hole principle, and thereby a torque can be transferred from a drive machine to the adapter 28.

In addition, the adapter 28 has two further grooves 38, provided on opposite surfaces, which grooves have a distance from the end face 40 of the adapter 28 at the insertion end 34. The grooves 38 serve to limit the axial movement of the adapter 28 in a drive machine, in particular during percussion, in that rollers or balls that are mounted in the drive machine engage into the grooves 38. Furthermore, the grooves 38 can contribute to the transfer of torque.

FIG. 3 shows a setting tool system 42 having a set 26 according to FIG. 2 or at least one setting tool 10 according to FIG. 1, as well as a capsule anchor 44. The capsule anchor 44 has an anchor rod 46 as well as a capsule 48, in which the at least two components are accommodated.

The anchor rod 46 has a drive head 50, which is configured as an external hex. Accordingly, the anchor rod 46 can be coupled, by way of the drive head 50, with a correspondingly configured setting tool 10, in other words a setting tool 10 having a recess 18 that matches the geometry of the drive head 50.

In addition, the setting tool system 42 can have a drive machine 52, shown schematically, for example a drill/screwdriver or a hammer drill. The drive machine 52 has a holder 54 for the adapter 28. Alternatively or supplementally, the setting tools 10 can be directly inserted into the holder 54 by way of the respective thread-free section 24.

In general, first a hole is introduced into a substratum into which the capsule anchor 44 is to be introduced, for example a borehole. Subsequently, this borehole can be cleaned.

Then the capsule 48 is inserted into the hole to fasten the capsule anchor 44 in place; at least two components are contained in the capsule, which components react with one another if they are mixed with one another. This is implemented in that the capsule anchor 44, in particular its anchor rod 46, is introduced into the borehole that has been provided with the capsule 48, while being rotated, wherein the capsule 48 breaks or tears and releases the at least two components. Due to the rotation of the capsule anchor 44 or of the anchor rod 46, the two components are mixed and react chemically with one another. After the mixture has cured, the capsule anchor 44 is held in the borehole with force fit.

As a function of the borehole and/or of the capsule anchor 44, the corresponding setting tool 10 is used, so that a recess 18 that is suitable for the drive head 50 of the capsule anchor 44 is provided in the selected setting tool 10.

Alternatively to separate configuration of the anchor rod 46 and of the capsule 48, the capsule 48 can also be arranged integrally on the anchor rod 46, so as to form an integral capsule anchor 44.

The invention claimed is:

1. A setting tool for a setting tool system for setting a capsule anchor, the setting tool comprising:

a shaft and a head arranged at one end of the shaft, wherein the head has a first connection section and the shaft has a second connection section and a third connection section, wherein the first connection section couples with a drive head of a capsule anchor, wherein the second connection section has a thread in a threaded section that borders on the head and that couples with a first tool rotating the head, and wherein the third connection section has a thread-free section on an end of the shaft that lies opposite the head and that couples with a second tool rotating the head different from the first tool.

2. The setting tool according to claim 1, wherein the first connection section is configured as a recess in the head of the setting tool.

3. The setting tool according to claim 2, wherein the recess has a hexagonal shape.

4. The setting tool according to claim 3, wherein the recess has a hexagonal socket geometry.

5. The setting tool according to claim 1, wherein the first connection section is configured as a pin.

6. The setting tool according to claim 5, wherein the pin has a hexagonal profile.

7. The setting tool according to claim 6, wherein the pin is a hexagonal shaft.

8. The setting tool according to claim 1, wherein the thread-free section has a hexagonal profile.

9. The setting tool according to claim 1, wherein the shaft and the head of the setting tool are configured in one piece.

10. A set for a setting tool system for setting capsule anchors, comprising:

an adapter configured to be coupled with a drive machine, and at least one setting tool according to claim 1, wherein the adapter corresponds to the first tool.

11. The set according to claim 10, wherein the set has multiple setting tools.

12. The set according to claim 11, wherein the first connection sections of the multiple setting tools are configured to be different in size.

13. The set according to claim 11, wherein the threaded sections and/or the thread-free sections of the multiple setting tools are configured to be the same.

14. The set according to claim 10, wherein the adapter has an SDS insertion end.

15. The set according to claim 14, wherein the adapter has a holding section for holding the setting tool at its end opposite the SDS insertion end.

16. The set according to claim 15, wherein the holding section has a thread.

17. The set according to claim 16, wherein the holding section has an inside thread.

18. A setting tool system comprising:

the setting tool according to claim 1, and a capsule anchor and/or a drive machine.

19. A setting tool system comprising:

the set according to claim 10, and a capsule anchor and/or a drive machine.

* * * * *